United States Patent [19]

Toso

[11] 3,955,850

[45] May 11, 1976

[54] MODULAR FURNITURE ELEMENTS

[76] Inventor: Lorenzo Toso, Strade Cisa n° 221, Bancole, Italy, 46047

[22] Filed: Aug. 19, 1974

[21] Appl. No.: 498,404

[30] Foreign Application Priority Data

Aug. 23, 1973 Italy ..... 46876/73
Jan. 11, 1974 Italy ..... 46802/74

[52] U.S. Cl. ..... 297/440; 108/64; 297/118; 297/232; 297/456

[51] Int. Cl.[2] ..... A47C 7/00

[58] Field of Search ..... 297/456, 445, 118, 248, 297/232, 249, 245, 440, 443; 108/64, 67, 11, 50; 52/590; D6/67, 61, 79

[56] References Cited

UNITED STATES PATENTS

| | | | |
|---|---|---|---|
| 2,694,611 | 11/1954 | Lorber | 108/67 |
| 3,214,874 | 11/1965 | Roberts | 52/590 X |
| 3,438,676 | 4/1969 | Brosk | 297/445 |
| 3,575,465 | 4/1971 | Dolby et al. | 297/118 |
| 3,600,036 | 8/1971 | Iskander | 297/445 X |
| 3,606,461 | 9/1971 | Moriyama | 297/445 |
| 3,606,461 | 9/1971 | Moriyama | 297/118 X |
| 3,729,229 | 4/1973 | Minsker | 297/445 X |

FOREIGN PATENTS OR APPLICATIONS

| | | | |
|---|---|---|---|
| 592,587 | 5/1959 | Italy | 52/590 |

*Primary Examiner*—James T. McCall
*Attorney, Agent, or Firm*—Brisebois & Kruger

[57] ABSTRACT

Modular furniture elements concave can be assembled to form an article of furniture, such as, armchairs, divans, and beds, consist of elements which, in plan, have two or three different but interrelated shapes. In plan, the different shapes are all based on a circle having a radius R. Each element of a first set of elements has a shape, in plan, defined by a convex semi-circular side of radius R and two converging cooncave sides extending from opposite ends of the convex side and merging together at a blunt edge. Each concave side is equal to one quarter of the circumference of a circle of radius R. Each element of a second set has a shape in plan which is defined by two interconnecting convex sides, each being equal to one quarter of the circumference of a circle of radius R. Each element of a third set has a shape in plan which is defined by a convex side equal to three-quarters the circumference of a circle of radius R and a concave side of one quarter the circumference of such a circle. Suitable connecting devices are provided for joining two or more of the same or the different shaped ones of these elements together in order to produce the desired article of furniture.

10 Claims, 20 Drawing Figures

Fig.15
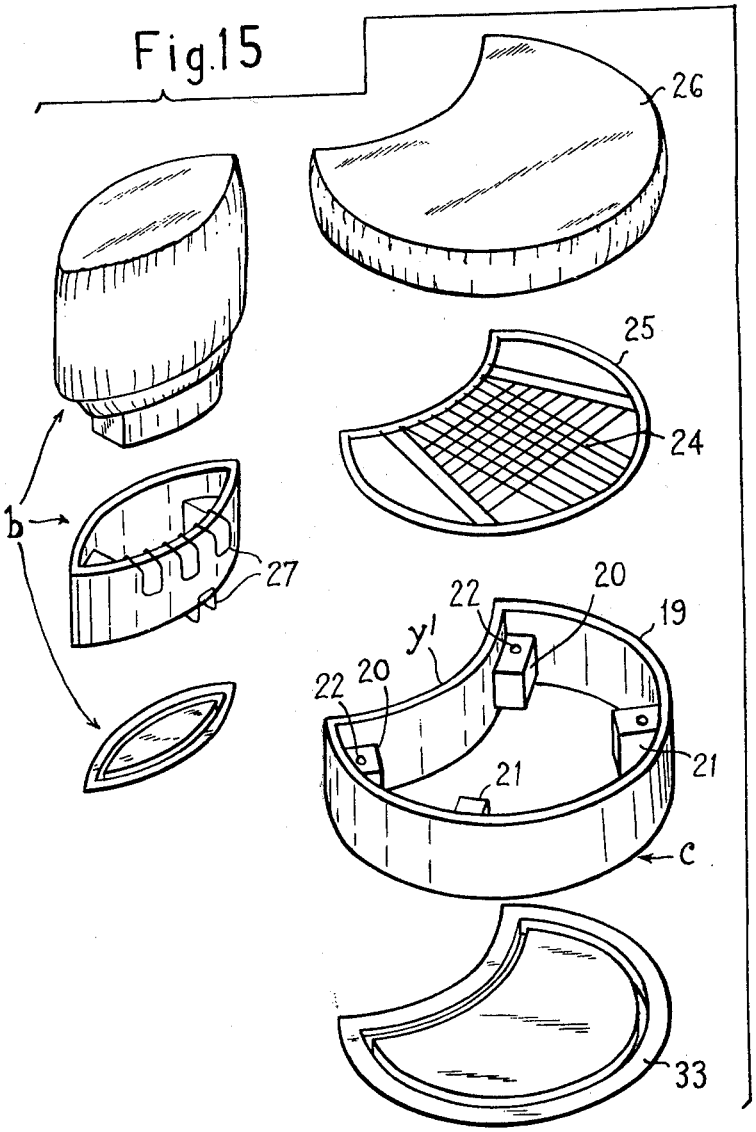
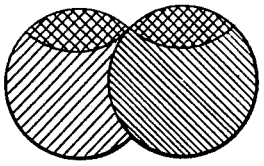
Fig.18
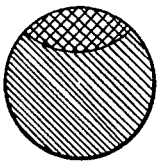
Fig.17

MODULAR FURNITURE ELEMENTS

BACKGROUND OF THE INVENTION

The modern furniture industry, always intent on research regarding new forms which will comply both with the need to obtain good aesthetic effects and with the requirement to keep production costs to a minimum, has not yet satisfactorily solved the problem of making available modular furniture elements which, with a limited number of different shaped elements which can be mass-produced, will enable the production of a multiplicity of different types of room furniture for differing purposes and having different layouts or plan arrangements.

SUMMARY OF THE INVENTION

An object of the present invention is to provide a group of modular furniture elements of two or three different shapes, any required number of which elements can be joined together so as to form articles of room furniture such as armchairs, divans, pouffes, beds and ottomans of various forms and suitable for use in any kind of room and rooms of differing size and plan.

This may be achieved, according to the invention, by constructing a group of modular furniture elements having two different basic shapes. One set of the elements has a basic shape which, in plan, is defined by a circle having two adjacent quarters of its circumference symmetrically reversed towards its center and the other set has a basic shape, in plan, defined by two circumference quarters joined at opposite ends to form, in effect, a pointed elipse. The curves defining these different shapes have substantially the same radius of curvature in all cases. The elements may have any required height and be coupled together in any suitable manner to form furniture for the middle of a room or wall furniture, which furniture may be adapted to satisfy the most varied requirements.

In a preferred embodiment, in addition to elements having the above two basic shapes, there is provided a third set of elements which differ from the previously described elements defined by a semicircle and two reversed quarter circumferences in that, in plan, each has a circular shape provided with only one peripheral concavity formed by a reversed quarter circumference. Its curved sides have a similar radius of curvature to those of the other two elements and can therefore be joined to the latter. The purpose of these third elements is to greatly improve the possibilities of use of the group, as a whole, by making it still easier to place the elements together whilst maintaining at a minimum the number of inter-related or complementary elements which are needed to form a required article of furniture.

BRIEF DESCRIPTION OF THE DRAWINGS

In order to explain more clearly the value and characteristic functional and structural features of the invention, two preferred embodiments are described hereafter which relate to sitting-room furniture, such as armchairs, divans and ottomans, and are illustrated in the Figures of the accompanying drawings. It is to be understood, however, that the embodiments are given merely by way of example and that alternative forms and improvements may be made to these without departing from the scope of the invention which can also be readily used with furniture of other types, for example, bookcases, chests of drawers, wall cupboards, kitchen furniture and the like.

In the drawings:

FIG. 15 is an exploded perspective view of the elements required for constructing an armchair, FIGS. 17, 18, 19 and 20 illustrate plan views of some possible combinations which can be obtained by coupling together the three different basic elements of the group.

DESCRIPTION OF THE PREFERRED EMBODIMENTS

Figure 1:
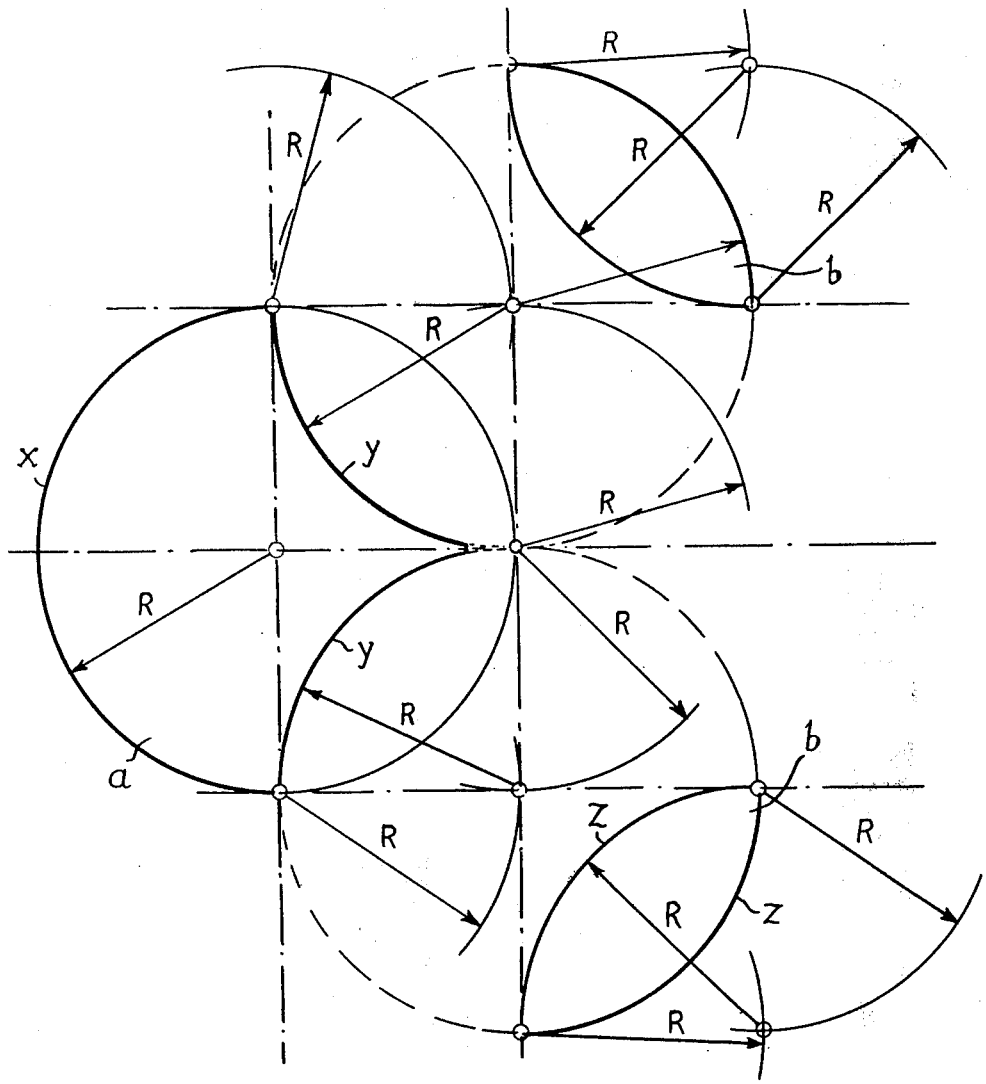
FIG. 1 diagrammatically illustrates the geometrical characteristics of the plan view of two forms of modular element according to the invention.

Referring to FIG. 1 of the accompanying drawings, there is illustrated the geometrical characteristics of two modular furniture elements or components *a* and *b* when viewed in plan. The element *a* is defined by a base circle of radius R, and has a convex semicircular side *x*, of radius R and two concave sides *y* which extend from opposite ends of the side *x* and each of which have the shape of a quarter of a circumference of a circle of which the radius is also R. It will, of course, be noted that the centers of curvature of the two sides *y* coincide respectively with the corners of the square which circumscribes the base circle. The point of convergence of the two sides *y* is blunted.

The element *b* is defined by two circumference sections *z* of radius R, each corresponding to one quarter of a circumference and joined at the corners. It is therefore identical with the sides *y* of the element *a*.

It can be seen at once that two elements *b* can be assembled to the element *a* to form a complete circumference and that a plurality of elements *a* can be assembled so that one of the sides *y* coincides with a portion of the side *x* of another element in each case. This makes it possible to make up articles of furniture having any required shape when seen in plan.

Figure 2:
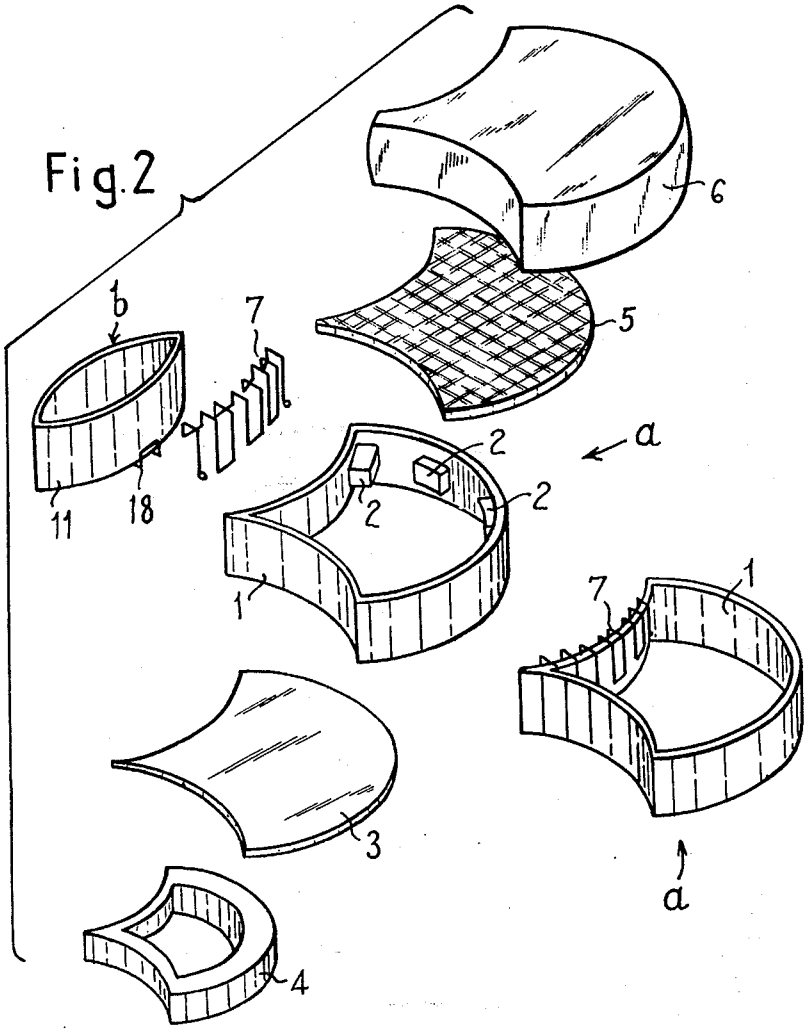
FIG. 2 illustrates an exploded perspective view of one of the modular elements adapted for making armchairs and/or divans, FIG. 3 likewise illustrates an exploded perspective view of the other modular element which is combined with the first one.
Figure 5:
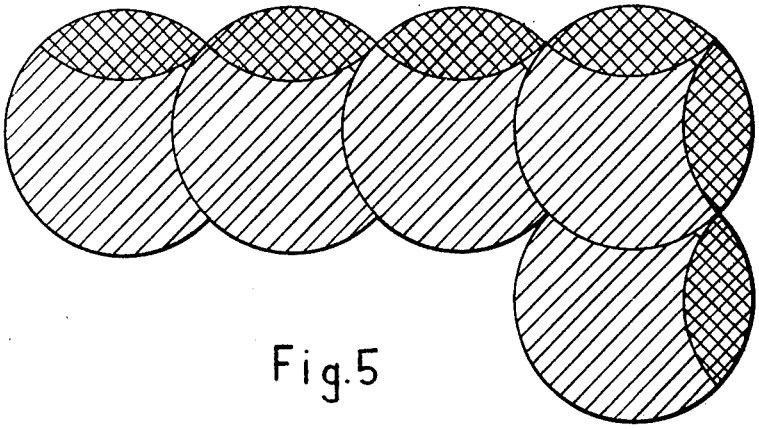
FIG. 5 illustrates a plan view of a divan for a wall with a corner, FIG. 6 similarly illustrates a plan view of a divan with four seats for the middle of a room.

FIG. 2 illustrates a furniture element of type *a* designed to form a seat. This element comprises a hollow central frame 1 of which the shape, when viewed in plan, is as described above and which has projections 2 on its inside. These projections are adapted to bear, at the bottom, on a rigid planar member 3 provided with a support base 4, whereas at the top they support a resilient planar member 5, for instance in the form of a metal network, on which a cushion 6 rests. It is possible to unite each element of type *a* with a similar adjacent element, as shown in FIG. 2, by locking the respective frames 1 together by means of a zig-zag metal framework 7. An element *a* can be united with an element *b* in the same way.

Figure 3:
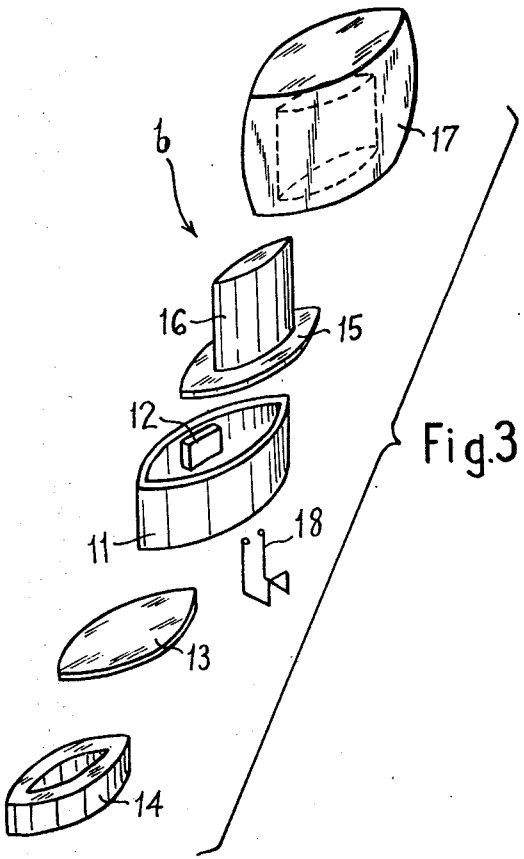

As shown in FIG. 3, each element *b* may also comprise a hollow central frame 11 having projections 12 similar to the projections 2. These projections rest on a rigid lower planar member 13 provided with a base 14. A second rigid planar member 15 supported on the projections 12 is provided with a central vertical core 16 which is also rigid and about which is placed a soft cushion 17. In this way the element *b* is adapted to form either an armrest or a backrest; in this case the element *b* is higher than the element *a*. An upwardly turned hook 18 extends from the bottom edge of the frame 11 and is adapted to be locked under the edge of an adjacent element *a*.

Figure 4:
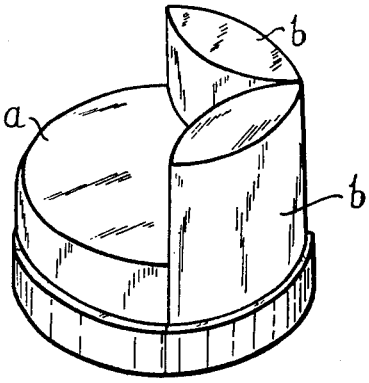
FIG. 4 illustrates a perspective view of an armchair constructed in accordance with the invention.
Figure 6:
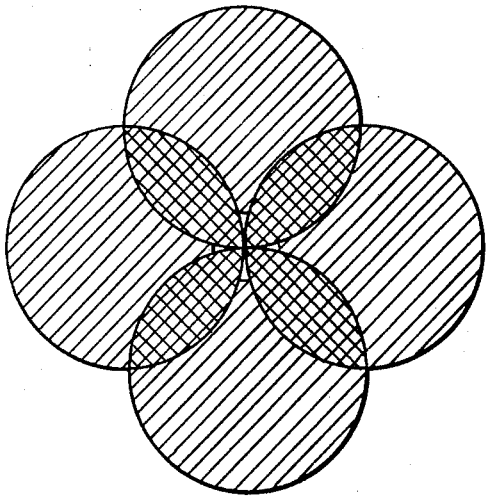
Figure 7:
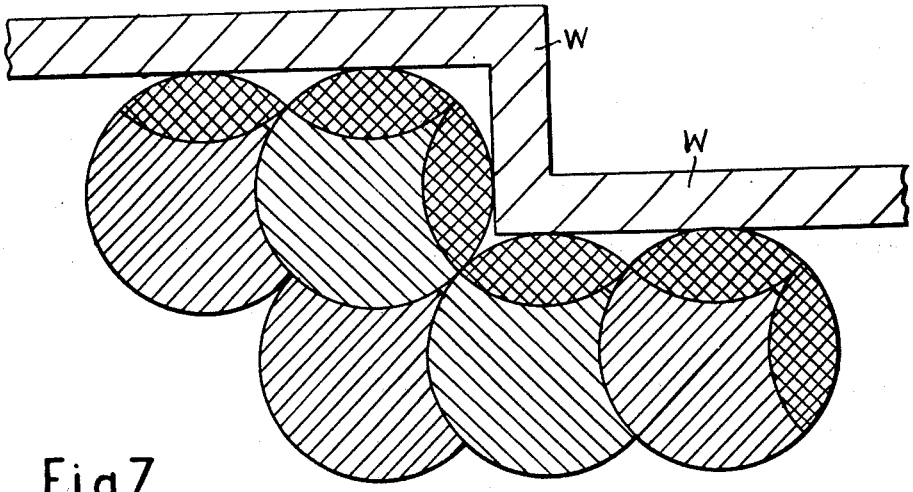
FIG. 7 is a plan view of a divan adapted to fit the end of a niche in a wall.
Figure 8:
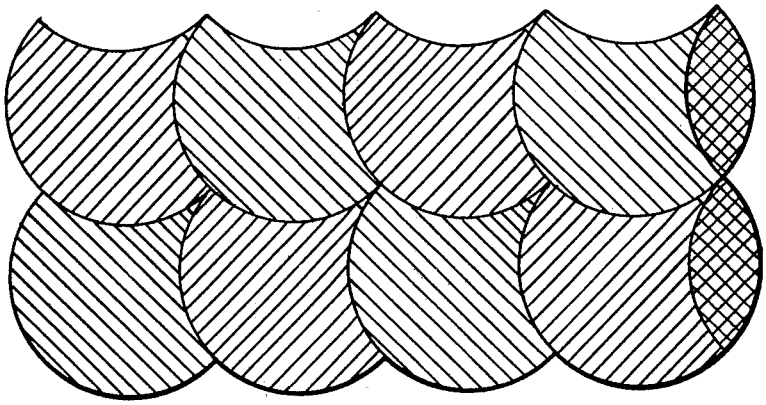
FIG. 8 is a plan view of a bed, FIGS. 9 and 10 respectively show two divans adapted to be fitted into a concave corner and round a convex corner.
Figure 9:
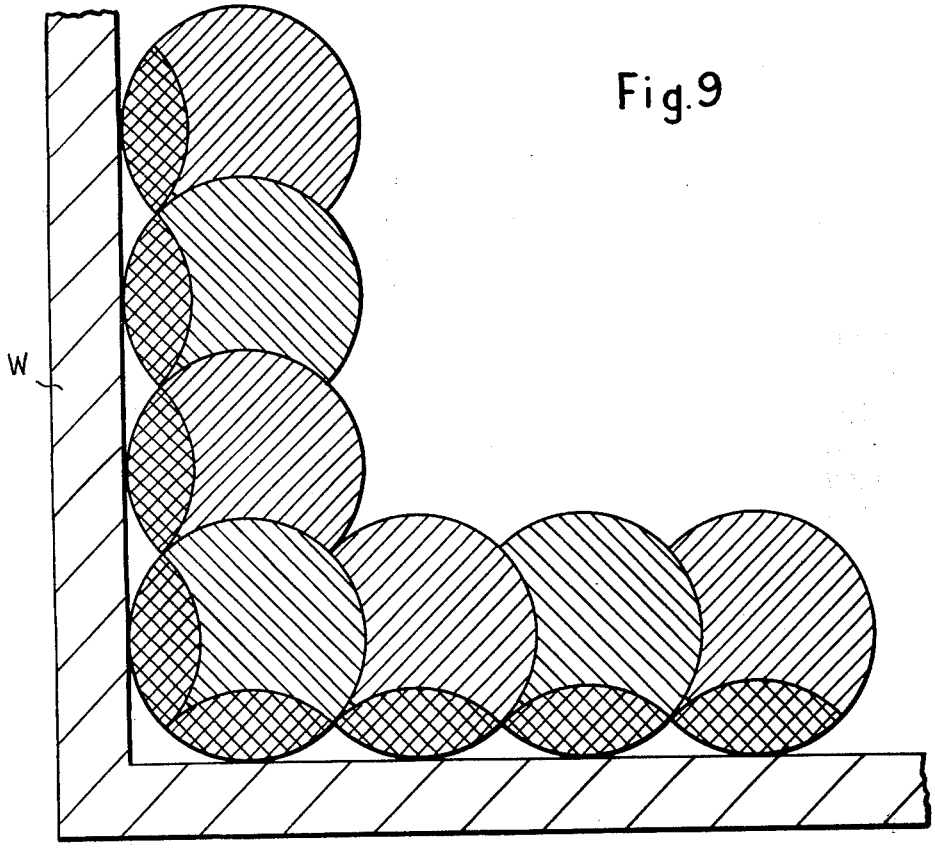
Figure 10:
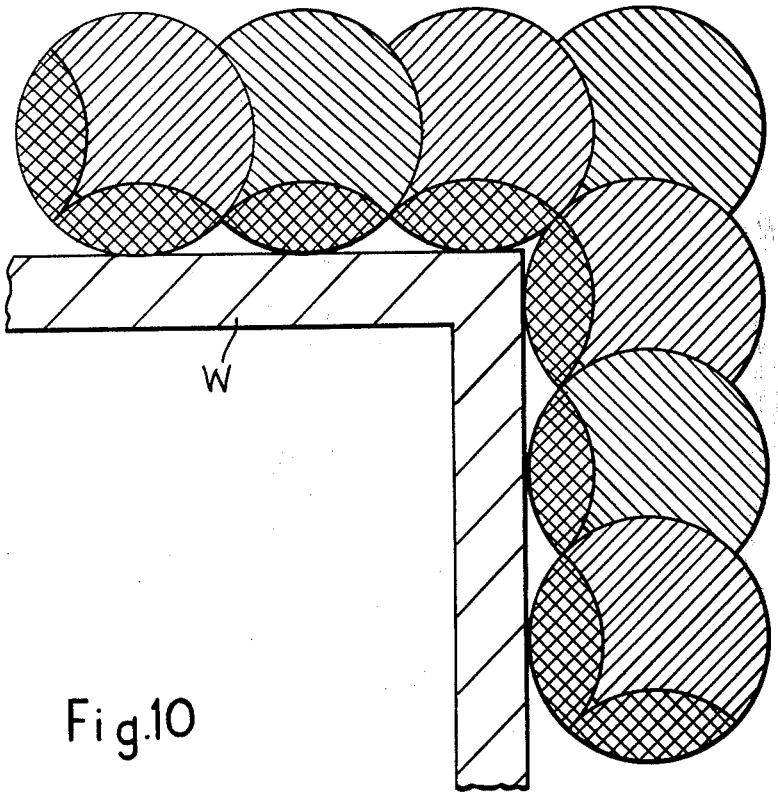
Figure 11:
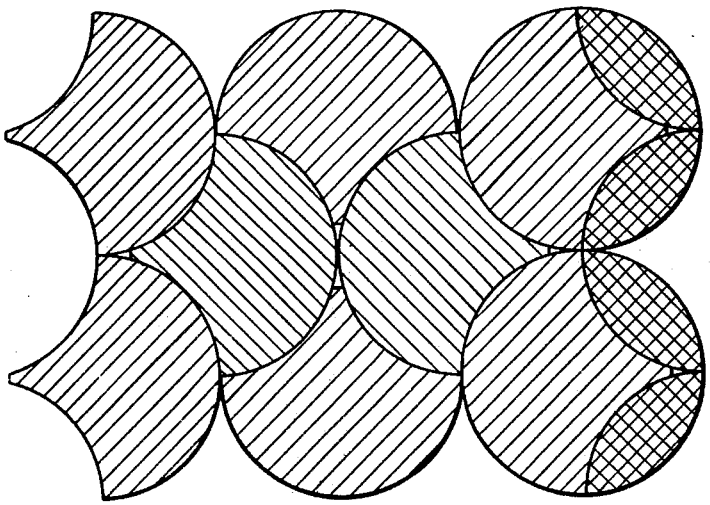
FIG. 11 illustrates a plan view of a second kind of bed.
Figure 12:
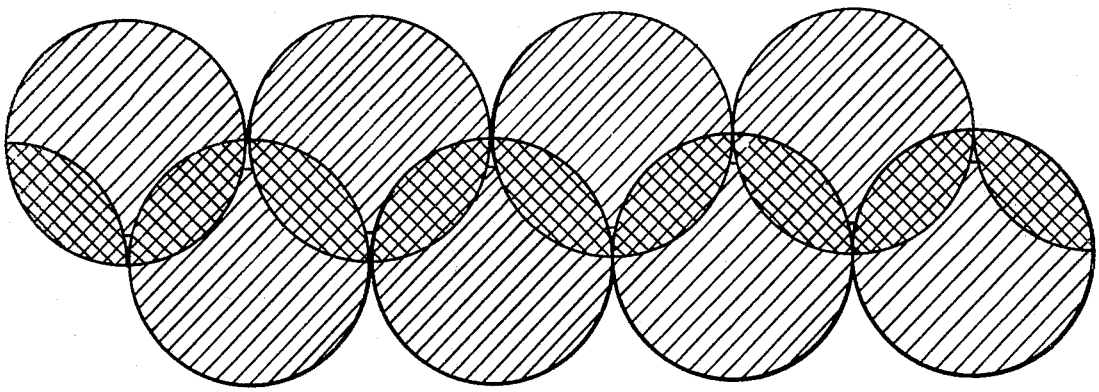
FIG. 12 is a plan view of a straight divan, for the middle of a room, which has two seating sides and can be of any required length.

FIG. 4 shows an armchair constructed by assembling two elements *b* with an element *a*. Moreover, FIGS. 5 to 12 show a series of further possible combinations of elements *a* and *b* and are not believed to call for any further explanation; in these Figures the elements *a* are differently hatched from the elements *b* so as to render the elements readily distinguishable. W indicates a portion of a wall.

Figure 13:
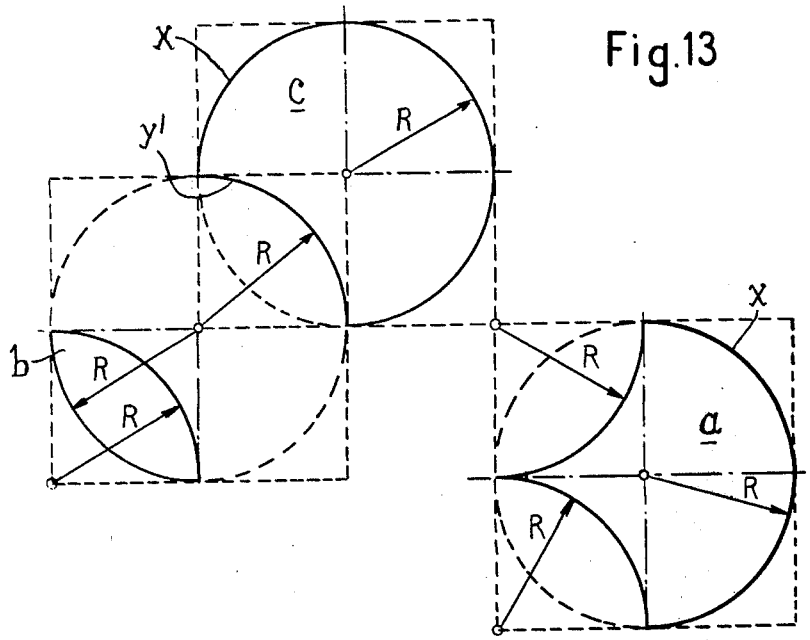
FIG. 13 is a plan view illustrating the geometrical characteristics of a third modular element which can be added to the group.

FIG. 13 illustrates how an improved group is formed from two elements *a* and *b*, as in the preceding embodiment, and a third element *c*. This latter element likewise has a generally circular side *x*, when viewed in plan, and has a radius R equal to that of the sides of the other two elements. However, it only has one quarter of the circumference *y'* reversed inwards to form a concavity.

Figure 14:
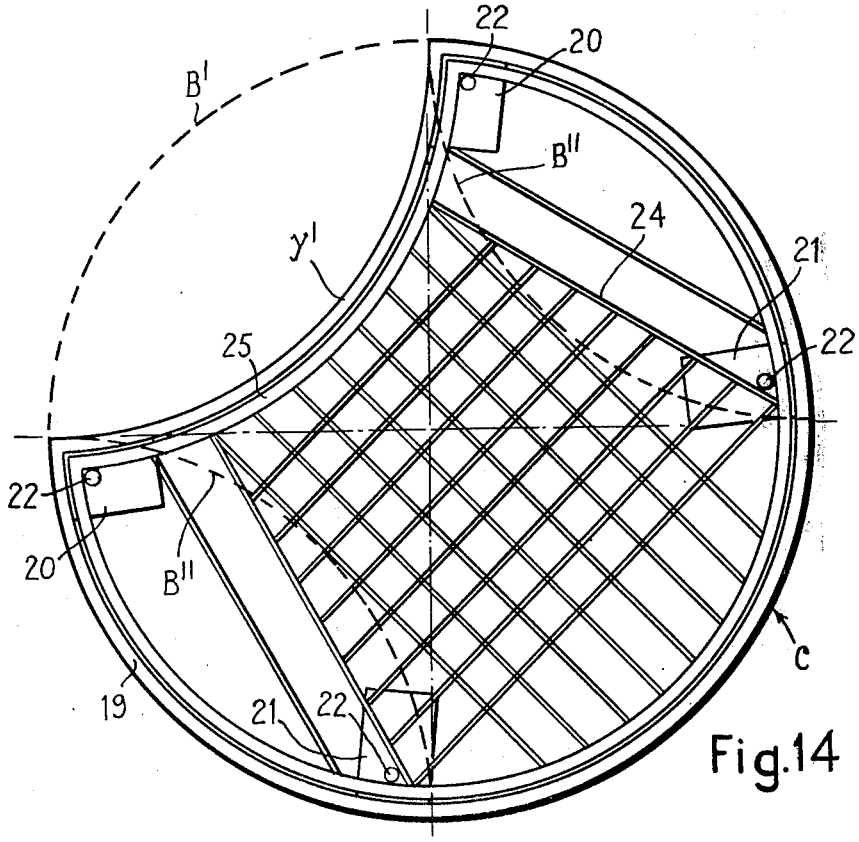
FIG. 14 is a plan view of the base frame of the third element.
Figure 16:
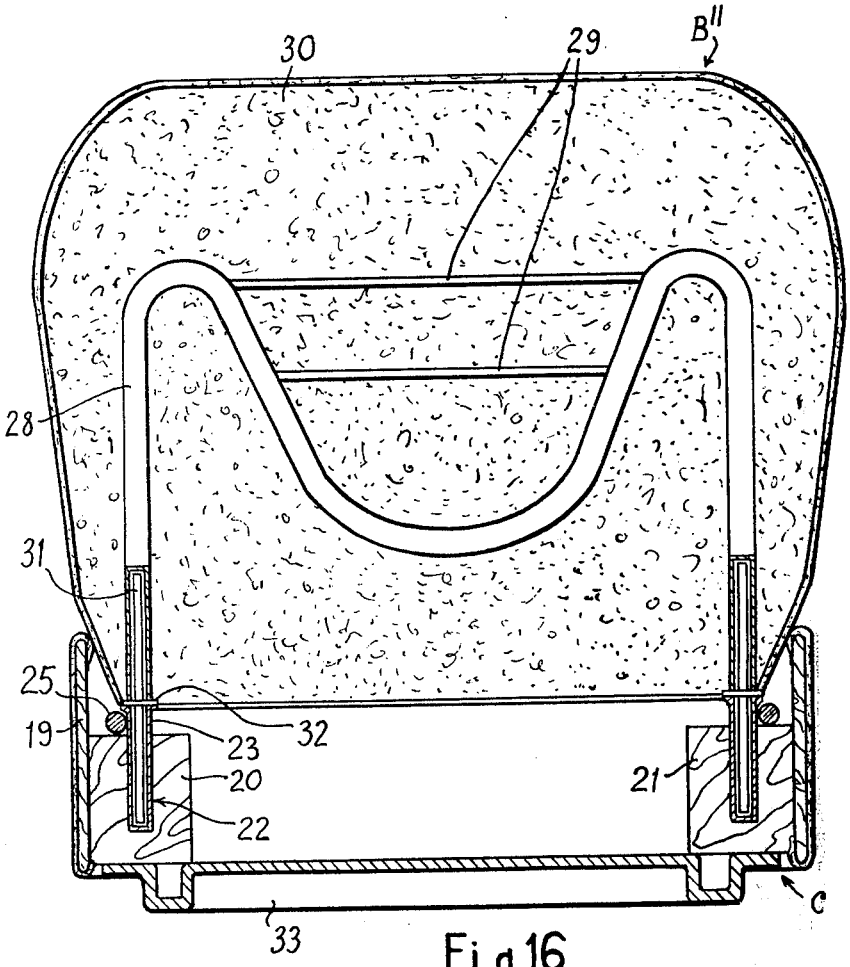
FIG. 16 is a vertical sectional view showing the assembly system for the attachment of the armrest to the third element.
Figure 19:
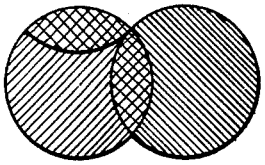
Figure 20:
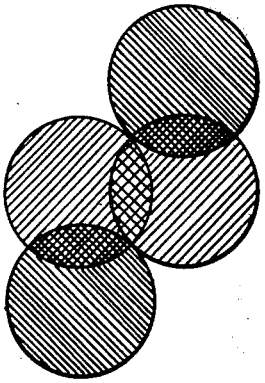

FIGS. 14, 15 and 16 illustrate the element *c* in detail. It comprises a closed wall or frame 19 made of plywood, which may be covered with fabric, leather or suitable synthetic material. In the corners formed by the concave wall *y'* of the frame there are two blocks of wood 20 of which the top and bottom planes are spaced from those of the frame 19. Two other blocks 21 are located on the inside of the frame and at the same level as those mentioned previously. These other blocks are also equally spaced from one another and from the blocks 20, so that the blocks subdivide the periphery of the frame 19 into four sections of approximately equal length. Each block 20, 21 has at its center a vertical hole 22 into which a metal tube 23 is inserted, as will be hereinafter described.

The element *c* is completed by a metal network 24 mounted on a reinforcement 25 which is made of metal tubing and of which the shape when seen in plan is similar to that of the frame 19. This reinforcement is supported on the blocks 20 and 21, and a cushion 26 made of soft material and covered with fabric, leather or synthetic material and having the same peripheral shape as that of the base frame 19 is disposed on the network (see FIG. 15).

The broken lines in FIG. 14 indicate the zones where the backrest B' and the armrests B'' are assembled to form an armchair. The backrest B' is formed by the element *b* having a cushion as provided in the first embodiment. This backrest is attached to the element *c* by means of the metal springs 27 having a zig-zag shape. These metal springs can be attached as shown in FIG. 15 and are identical with the members 7 and 18 described with reference to the preceding embodiment. When the element *b* is assembled, this completes the circumference of the element *c* in the section interrupted by the concavity *y'* provided in this element. The armrests B'', on the other hand, each comprise a reinforcement 28 made of metal tubing bent into an M-shape; this reinforcement is provided with springs 29 and is embedded in a body which is made of soft material 30 and which, when viewed in plan, has the same roughly elliptical shape as that of the backrest B'; this body too is covered with fabric, leather or a suitable synthetic material. This can be seen in FIG. 16 which also illustrates the system of attachment of an armrest to the frame of the seat element *c*.

The system for attaching the armrest to the frame (FIG. 16) comprises cylindrical rods 31 each provided with a widened part 32 near the middle of the rod. These rods are each introduced into respective ones of the tubes 23, which are inserted into the blocks 20 and 21, and into respective ones of the vertical branches of the reinforcement 28 of the armrest. FIG. 16 also shows that the element *c* rests on a support base 33 which replaces the feet usually provided in furniture of this type. It will also be noted that the cushions of the backrest and of the armrests, as described, can be put on any one of the elements *a*, *b*, *c* constituting the improved group, according to the nature of the furniture to be made.

It will be apparant that the height of the cushions of the armrests may be equal to or less than that of the cushion of the backrest; this makes it possible, while using the same elements, considerably to vary the aesthetic appearance of the article of furniture.

FIGS. 17, 18, 19 and 20 diagrammatically illustrate in plan, some of the possible furniture structures which can be produced by joining together several of the elements comprising the group of the second embodiment. For clarity, the different elements are shown by different hatching.

I claim:

1. A group of modular furniture elements which can be assembled to form an article of room furniture, comprising:

a. at least one first element which has a shape, in plan, defined by a convex substantially semicircular side of radius R and two converging concave sides extending from opposite ends of said convex side and merging together in a common edge, each of said concave sides being substantially one quarter of the circumference of a circle of radius R, and b. at least one second element which has a shape, in plan, defined by two interconnecting convex sides, each of which is substantially one quarter of the circumference of a circle of radius R.

2. A group of elements as claimed in claim 1, wherein said first element comprises:

a. a hollow central frame having internal projections, b. a support base underneath said frame, c. a resilient planar member supported at the top of said frame, d. a cushion supported on said planar member, e. said frame, base, planar member and cushion each having said shape in plan, defined by a convex semicircular side and two converging concave sides.

3. A group of elements as claimed in claim 2, wherein said frame is provided with hook means for attaching said frame to an adjacent element.

4. A group of elements as claimed in claim 1, wherein said second element comprises:

a. a hollow central frame, b. a support base underneath said frame, c. a rigid planar member supported at the top of said frame and having a rigid upright support projecting centrally therefrom, d. a cushion located about said upright support, e. said frame, base, planar member, and cushion each having said shape, in plan, which is defined by two interconnecting convex sides.

5. A group of elements as claimed in claim 4, wherein said frame is provided with hook means for attaching said frame to an adjacent element.

6. A group of elements as claimed in claim 1, including at least one third element which has a shape, in plan, defined by a circle of radius R with one quarter of its circumference reversed towards the center of the circle.

7. A group of elements as claimed in claim 6, wherein said third element comprises:

a. a hollow central frame, b. a support base underneath the said frame, c. a resilient member in the form of a metal network supported at the top of said frame, d. a cushion supported on the said resilient member, e. said frame, base, resilient member and cushion each having said shape, in plan, defined by a circle with one quarter of its circumference reversed towards its center.

8. An article of furniture comprising:

a. at least one first element which has a shape, in plan, defined by a circle of radius R with two contiguous quarters of the circumference thereof reversed towards the center of said circle, and b. at least one second element which has a shape, in plan, which is substantially a pointed elipse and which is defined by two interconnecting convex sides, each of which is substantially equal to one quarter of the circumference of a circle of radius R, and c. means connecting said elements together.

9. An article of furniture as claimed in claim 8, including at least one third element which has a shape, in plan, defined by a circle of radius R with only one quarter of its circumference reversed towards the center of said circle.

10. An article of furniture as claimed in claim 9, wherein each element comprises:

a. a hollow frame with substantially vertical generatrices, b. said frame constituting the carrying structure of the element and having members for supporting a cushion and a backrest, c. said frame being adapted to be connected to the frame of an adjacent element by being disposed in contact with said frame of said adjacent element and being secured thereto by means of a clamp of zig-zag shape.

* * * * *